US009439494B2

(12) United States Patent
Brady, Jr.

(10) Patent No.: US 9,439,494 B2
(45) Date of Patent: Sep. 13, 2016

(54) ELECTROLESS HYDRODYNAMIC CLEANING APPLIANCE FOR THE RESTORATION AND REJUVENATION OF WET SHAVING DISPOSABLE RAZORS

(71) Applicant: Fred Wm Brady, Jr., Las Vegas, NV (US)

(72) Inventor: Fred Wm Brady, Jr., Las Vegas, NV (US)

( * ) Notice: Subject to any disclaimer, the term of this patent is extended or adjusted under 35 U.S.C. 154(b) by 210 days.

(21) Appl. No.: 14/201,818

(22) Filed: Mar. 8, 2014

(65) Prior Publication Data

US 2015/0250285 A1 Sep. 10, 2015

Related U.S. Application Data

(60) Provisional application No. 61/780,599, filed on Mar. 13, 2013.

(51) Int. Cl.
*B08B 9/00* (2006.01)
*A45D 27/46* (2006.01)

(52) U.S. Cl.
CPC ..... *A45D 27/46* (2013.01)

(58) Field of Classification Search
CPC ..... B26B 21/22; B26B 1/05; A45D 27/46; B65D 81/22
USPC ..... 134/182; 30/41
See application file for complete search history.

(56) References Cited

U.S. PATENT DOCUMENTS 535,417 A * 3/1895 Sampson ..... B01F 9/0005 366/232
3,352,630 A * 11/1967 Fischer ..... A61L 2/18 132/289
5,007,533 A * 4/1991 Purohit ..... B65D 81/22 134/162
5,265,337 A * 11/1993 Lowder ..... B26B 21/52 30/41
5,365,958 A * 11/1994 Stuhlmacher, II ..... A45D 27/46 134/166 R
5,934,459 A * 8/1999 Winsell ..... A45D 27/24 206/208
6,009,622 A * 1/2000 Liedblad ..... A45D 27/46 30/34.05
D433,187 S * 10/2000 Dettman ..... D28/44
6,131,230 A * 10/2000 Manabat ..... A45D 27/46 15/104.92
6,385,850 B1 * 5/2002 Coulthard, Jr. ..... B26B 21/4062 30/41.5
6,499,218 B2 * 12/2002 Rocha ..... B26B 21/22 30/346.57
6,886,211 B2 * 5/2005 Severino ..... A47L 25/00 15/210.1
2008/0248731 A1 * 10/2008 Fletcher ..... B24B 1/04 451/164
2011/0138638 A1 * 6/2011 Winsell ..... A45D 27/24 30/538

* cited by examiner

*Primary Examiner* — Nina Bhat
(74) *Attorney, Agent, or Firm* — Brown & Michaels, PC

(57) ABSTRACT

An electroless disposable razor cleaning appliance employs rotational hydrodynamic cleaning action as applied to the blades and structural members of a multi-bladed disposable shaving instrument by employing standing water to create strong vortex shearing forces which remove all traces of foreign matter buildup.

17 Claims, 11 Drawing Sheets

ELECTROLESS HYDRODYNAMIC CLEANING APPLIANCE FOR THE RESTORATION AND REJUVENATION OF WET SHAVING DISPOSABLE RAZORS

CROSS-REFERENCE TO RELATED APPLICATIONS

This application claims the benefit of provisional patent application Ser. No. 61/780,599, filed 2013 Mar. 13 by the present inventor

BACKGROUND OF THE INVENTION

The present invention is in the technical field of personal grooming aid devices. More particularly, the present invention is in the technical field wet shaving instruments. More particularly, the present invention is in the technical field of maintaining and extending the serviceability of disposable wet shaving instruments.

In the prior art there exists a number of attempted solutions to solve the problem of clogged disposable razor head assemblies, and in particular the clogging problem associated with multiple bladed disposable razors due to the accumulation of hair and shaving stubble as these become wedged between the close spacing of the blades. Of the most prominent:

There exists the prior art practice of bringing to market a number of abrading materials such as bristle brushes, metallic tools and wall mounting pads, all purposefully claiming the ability to scrape away foreign material clinging to the blades and other hard-to-reach areas. These products at the same time contribute to the unintended deleterious effect of nicking and damaging the shaving edges.

There exists still further the prior art practice of publicly recommending a source of very hot water in the home or other area for the purpose of rinsing away shaving debris. Such recommendations at the same time contribute to the unintended deleterious effect of dulling the finely honed steel edges due to repeated thermal expansion and contraction.

There exists still further the prior art practice of bringing to market various pressure augmentation devices which claim to dislodge stubborn shaving debris by forcing tap water through several restrictive passages within the device, thereby causing multiple jets of pressurized water to be directed through the shaving head. These devices at the same time are prone to causing the deleterious effect of unwanted wetting in and around the immediate area of the lavatory including walls, mirrors, counter tops and floors.

There exists still further the prior art practice of publicly recommending assiduous drying of the disposable razor after each use with absorbent materials such as cotton fabric or paper toweling. Such recommendations at the same time tend to be dismissive of any further discussion over the difficulty in reaching all surfaces of the shaving instrument including the undersides of the razors.

| U.S. patent Documents | | |
|---|---|---|
| 6,886,211 | May 3, 2005 | Severino |
| 6,385,850 | May 14, 2002 | Coulthard, Jr. |
| 6,131,230 | Oct. 17, 2000 | Manabat |
| D433,187 | Oct. 31, 2000 | Dettman |
| 5,365,958 | Nov. 22, 1994 | Stuhlmacher, II |
| 5,265,337 | Nov. 30, 1993 | Lowder |

SUMMARY OF THE INVENTION

The present invention is a shaving instrument cleaning appliance capable of maintaining and extending the useful life of wet shaving disposable razors by taking advantage of the principle of rotational vortex flow dynamics. The principle behind the system is to spin at high velocity a disposable razor shaving head in any convenient source of standing water, such as in basin or sink, thereby creating what are known as pressure gradients across all exposed surfaces of the head assembly, both metallic and nonmetallic. Then by keeping the appliance moving in a circular motion, along with other movements such as side-to-side and up-and-down directions, these pressure gradients build into substantial shearing forces which the debris trapped between the blades and interior crevices of the shaving head are unable to withstand.

DETAILED DESCRIPTION OF THE INVENTION

Figure 1:
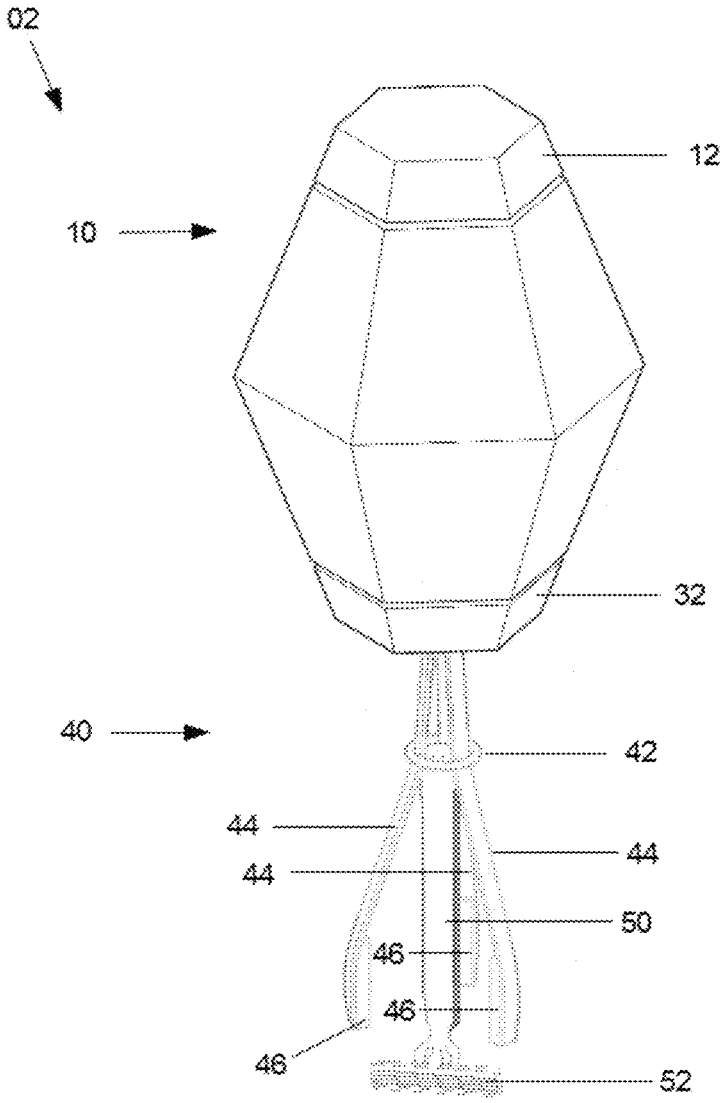
FIG. 1 is a perspective view of an electroless razor cleaning appliance of the present invention.
Figure 2:
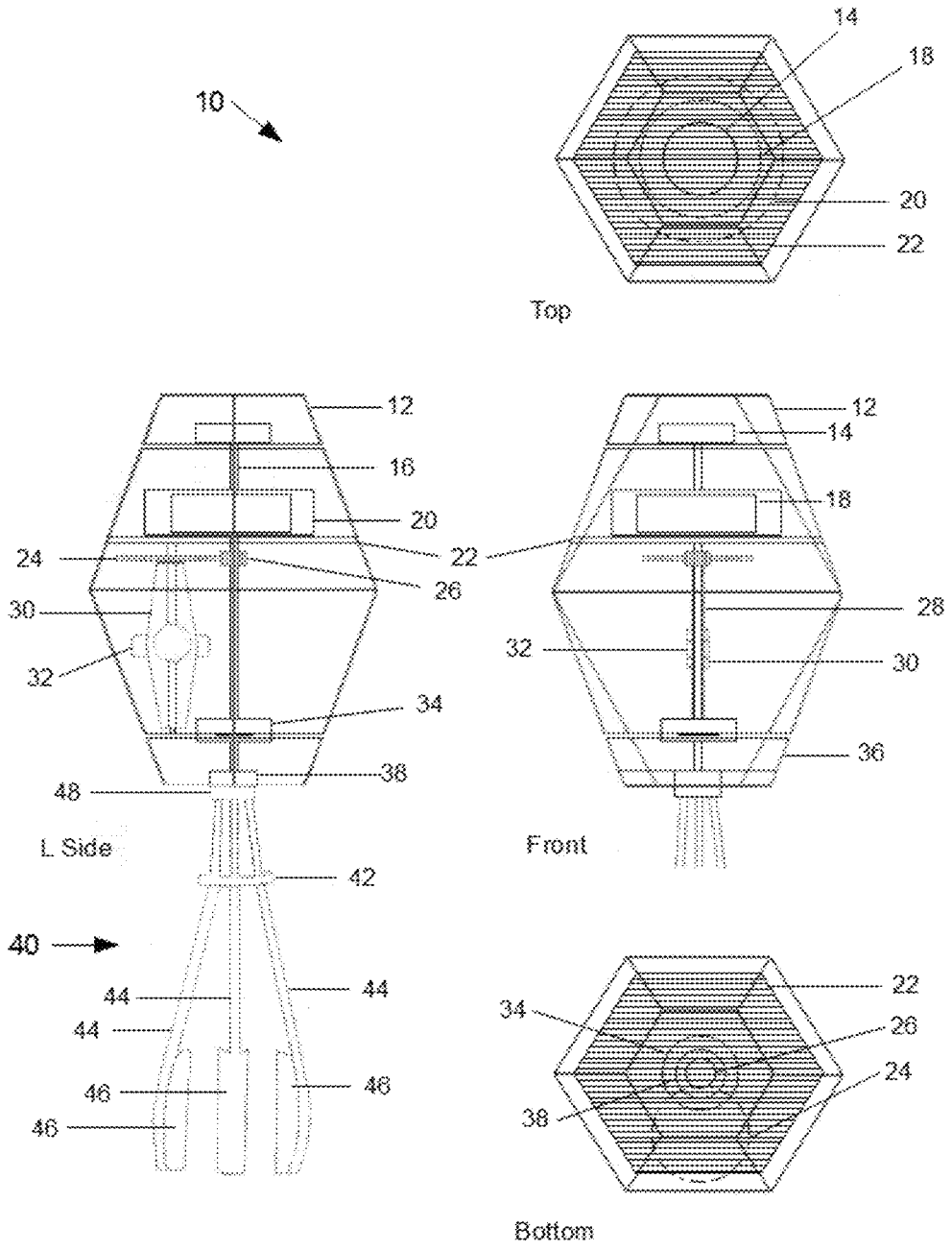
FIG. 2 is a plan view of an electroless razor cleaning appliance of the present invention.

Referring to the invention in more detail, in FIG. 1 and FIG. 2 there is shown an electroless hydrodynamic disposable razor cleaning appliance 02 consisting of a control head housing assembly 10 and a razor handle capture assembly 40. In further discussing the control head housing assembly 10, contained therein is an integrated enclosure section windup mechanism 12, a ratchet assembly 14, a spring motor input shaft 16, a spring 18, a spring barrel 20, a spring motor shelf 22, a spring barrel output shaft 28, a governor drive gear 24, a governor pinion gear 26, a governor assembly 30, a governor weight set assembly 32, an integrated enclosure section brake mechanism 36, a brake assembly 34 and a clutch disconnect assembly 38. In similarly discussing the razor handle capture assembly 40, there is a clutch disconnect assembly 48, a sliding ring tensioner 42, a set of spring steel arms 44, a set of foam plastic pressure pads 46, a disposable razor handle 50 and a disposable razor head assembly 52.

In more detail, referring to FIG. 1 and FIG. 2, the user would prepare the electroless hydrodynamic disposable razor cleaning appliance 02 for operational use and begin the cleaning process by mating the two halves of the device. This would be done by fitting the control head housing assembly 10 together with the razor handle assembly 40 via both halves of the clutch disconnect assembly 38 and 48. To accomplish this the user would mate the two halves of the clutch disconnect assembly 38 and 48 by rotating the clutch until the guide pins come into alignment. Finally, the user would press against both assemblies until a solid click can be heard.

Still with reference to FIG. 1 and FIG. 2, the user would immobilize the spring barrel output shaft 28 by engaging the brake assembly 34. This would be accomplished through a $\frac{1}{8}^{th}$ revolution turn of the integrated enclosure section brake mechanism 36 via a short twist to the right of the enclosure's lower section, also a part of the enclosure section brake mechanism 36. Following this action, the user would be positioned to install the handle 50 of a commercially available disposable razor 52 in the razor handle capture assembly 40.

Continuing with reference to FIG. 1 and FIG. 2, the razor handle 50 would be inserted into the space between the spring steel arms 44 through to the point where the razor handle 50 will go no farther. The sliding ring tensioner 42 would then be manipulated in a drawdown fashion so as to draw in and tighten the razor handle 50 against the set of three foam plastic pressure pads 46.

Continuing further with reference to FIG. 1 and FIG. 2, the spring motor 18 windup operation would be allowed to proceed by utilizing the ratchet assembly 14. This would be accomplished through the integrated enclosure section windup mechanism 12 via a back-and-forth twisting operation on the enclosure's upper section, also a part of the enclosure section windup mechanism 12. The windup operation would be concluded when maximum resistance to any further turning is felt through the enclosure section windup mechanism 12, at which point the electroless hydrodynamic disposable razor cleaning appliance 02 will have been made ready to begin the cleaning process.

Figure 3:
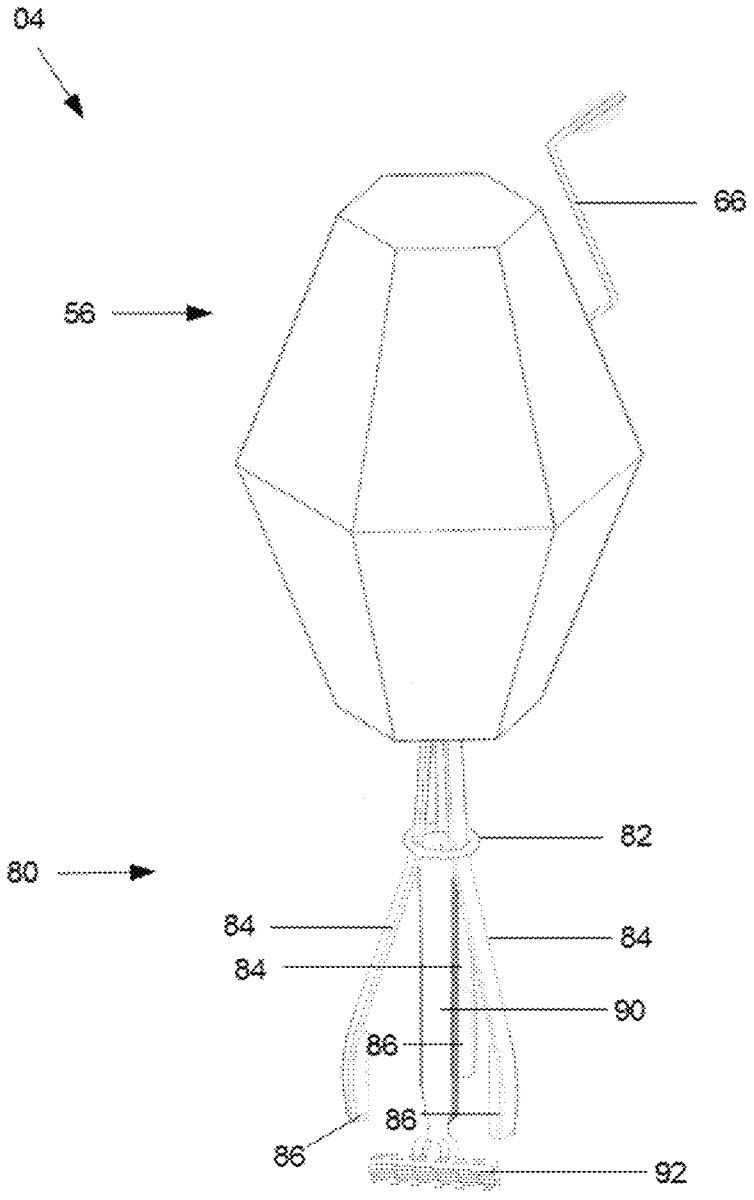
FIG. 3 is a perspective view of an electroless razor cleaning appliance of the present invention.
Figure 4:
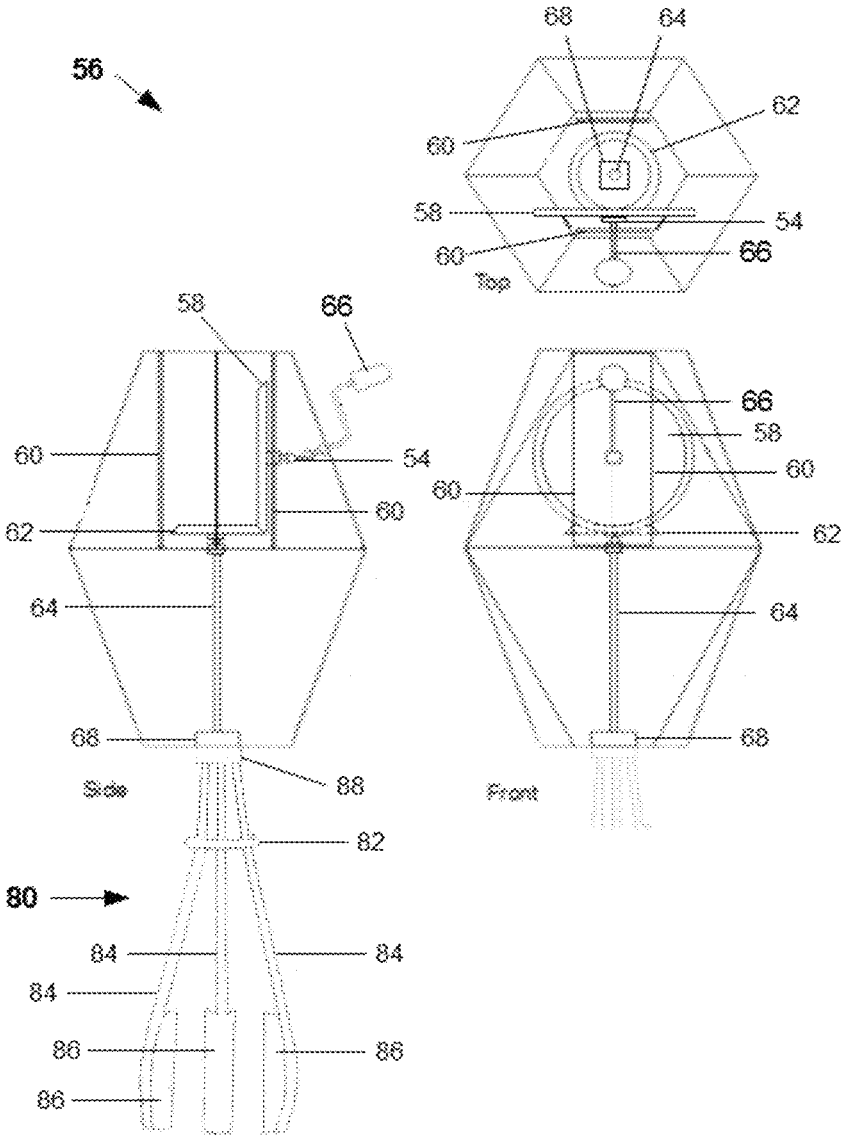
FIG. 4 is a plan view of an electroless razor cleaning appliance of the present invention.

Referring now to the invention in more detail, in FIG. 3 and FIG. 4 there is shown an electroless hydrodynamic disposable razor cleaning appliance 04 consisting of a control head housing assembly 56 and a razor handle capture assembly 80. In further discussing the control head housing assembly 56, contained therein is an enclosure section hand crank 66 mechanism connecting to a universal coupler 54, a drive gear 58, and an output gear 62 mounted within a gear assembly subchassis 60. Power from the output gear 62 is transmitted through an output shaft 64 to a clutch disconnect assembly 68. In similarly discussing the razor handle capture assembly 80, there is a clutch disconnect assembly 88, a sliding ring tensioner 82, a set of spring steel arms 84, a set of foam plastic pressure pads 86, a disposable razor handle 90 and a disposable razor head assembly 92.

In more detail, still referring to FIG. 3 and FIG. 4, the user would prepare the electroless hydrodynamic disposable razor cleaning appliance 04 for operational use and begin the cleaning process by mating the two halves of the device. This would be done by fitting the control head housing assembly 56 together with the razor handle assembly 80 via both halves of the clutch disconnect assembly 68 and 88. To accomplish this the user would mate the two halves of the clutch disconnect assembly 68 and 88 by rotating the clutch until the guide pins come into alignment. Finally, the user would press against both assemblies until a solid click can be heard. Following this action, the user would be positioned to install the handle 90 of a commercially available disposable razor 92 in the razor handle capture assembly 80.

Continuing with reference to FIG. 3 and FIG. 4, the razor handle 90 would be inserted into the space between the spring steel arms 84 through to the point where the razor handle 90 will go no farther. The sliding ring tensioner 82 would then be manipulated in a drawdown fashion so as to draw in and tighten the razor handle 90 against the set of three foam plastic pressure pads 86, at which point the electroless hydrodynamic disposable razor cleaning appliance 04 will have been made ready to begin the cleaning process.

Figure 5:
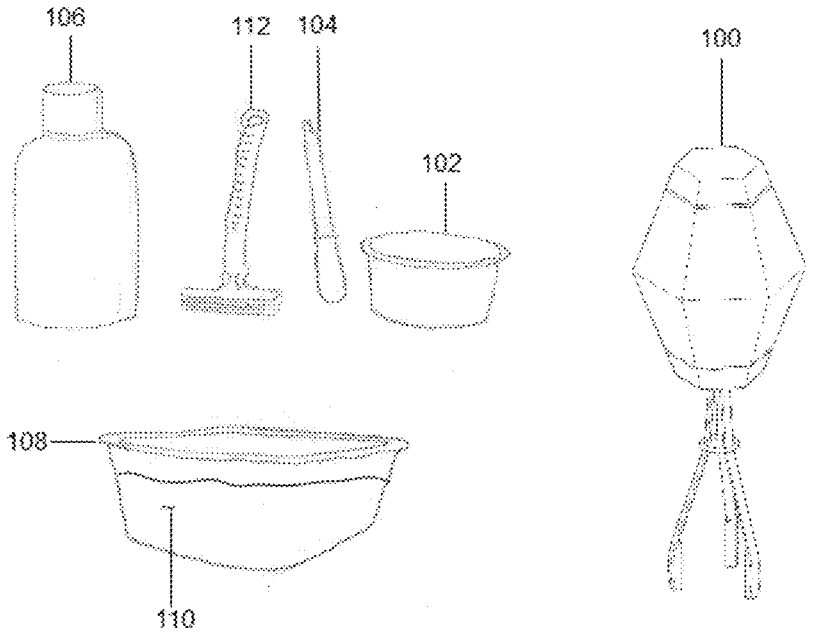
FIG. 5 is a perspective view of system requirements associated with an electroless razor cleaning appliance of the present invention.
Figure 6:
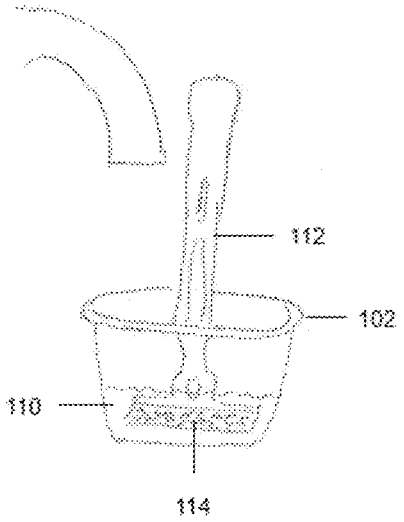
FIG. 6 is a perspective view of system requirements associated with an electroless razor cleaning appliance of the present invention.
Figure 6:
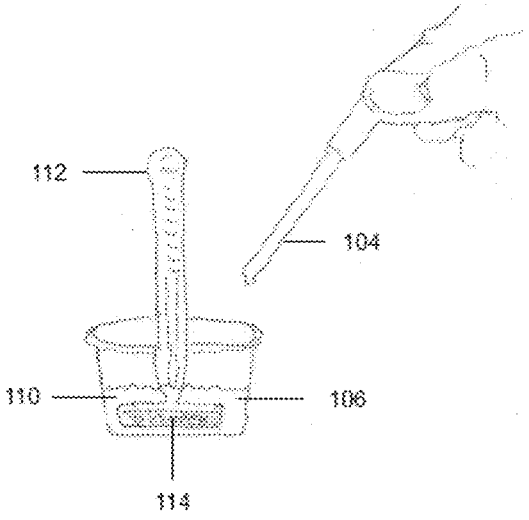

In more detail, referring now to FIG. 5 and FIG. 6, there are shown the required elements for carrying out a multi-bladed disposable shaving instrument rejuvenation process, wherein a complete restoration of the disposable shaving instrument 112 has been made necessary by the passage of time and, for one reason or another, a failure to discard the unserviceable unit in a timely manner. They are: a multi-bladed disposable shaving instrument 112; a two-ounce condiment container 102 of the type often used in restaurants; a 5 ml eyedropper 104; a six-ounce container of a wetting agent 106 such as glycerol, a skin protectant, available from any pharmacy; a 2½ gallon basin 108 containing at least two gallons of tap water 110 at room temperature and an electroless hydrodynamic disposable razor restoration and rejuvenation appliance 100.

Still with reference to FIG. 5 and FIG. 6, a procedural removal of the encrusted debris that has built up largely toward the trailing edges of the blades and structures on the obverse of the disposable shaving instrument 112 head assembly 114, is begun by using a soaking solution consisting of 50% tap water 110 and 50% wetting agent 106, starting with about ½ oz. of tap water 110 in a two-ounce condiment container 102 or just enough to cover the disposable shaving instrument 112 head assembly 114. Then after allowing the disposable shaving instrument 112 head assembly 114 to soak for 5 minutes in the tap water 110, an equal amount, or approximately 6 eyedroppers 104 by volume, of wetting agent 106 is to be added, allowing the disposable shaving instrument 112 head assembly 114 to soak in the prepared solution for another 15 minutes.

Figure 7:
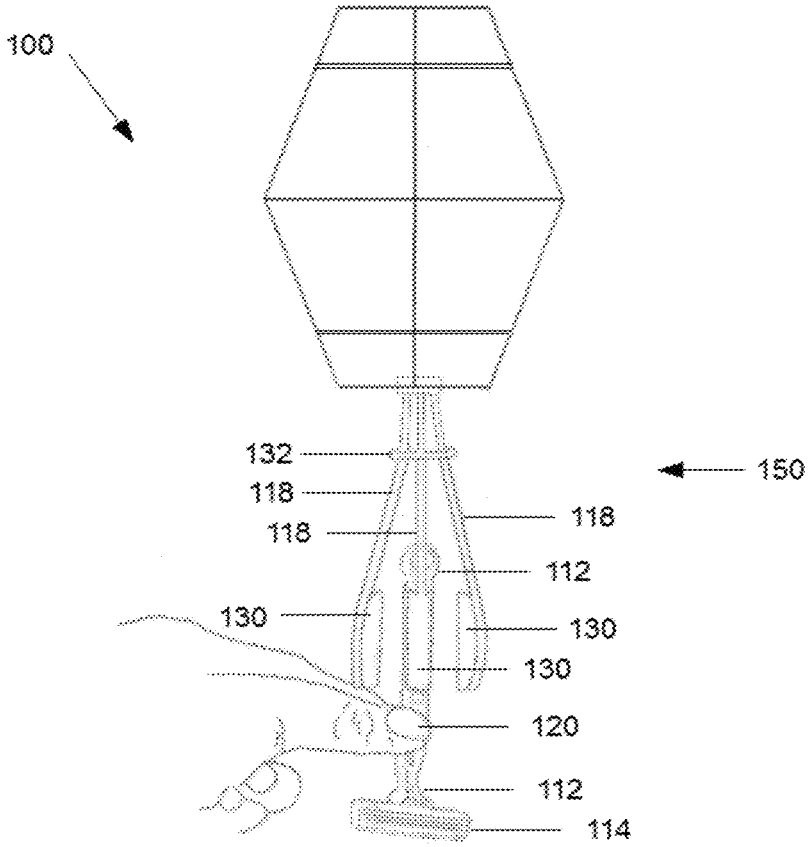
FIG. 7 is a partial perspective view of an electroless razor cleaning appliance of the present invention.
Figure 8:
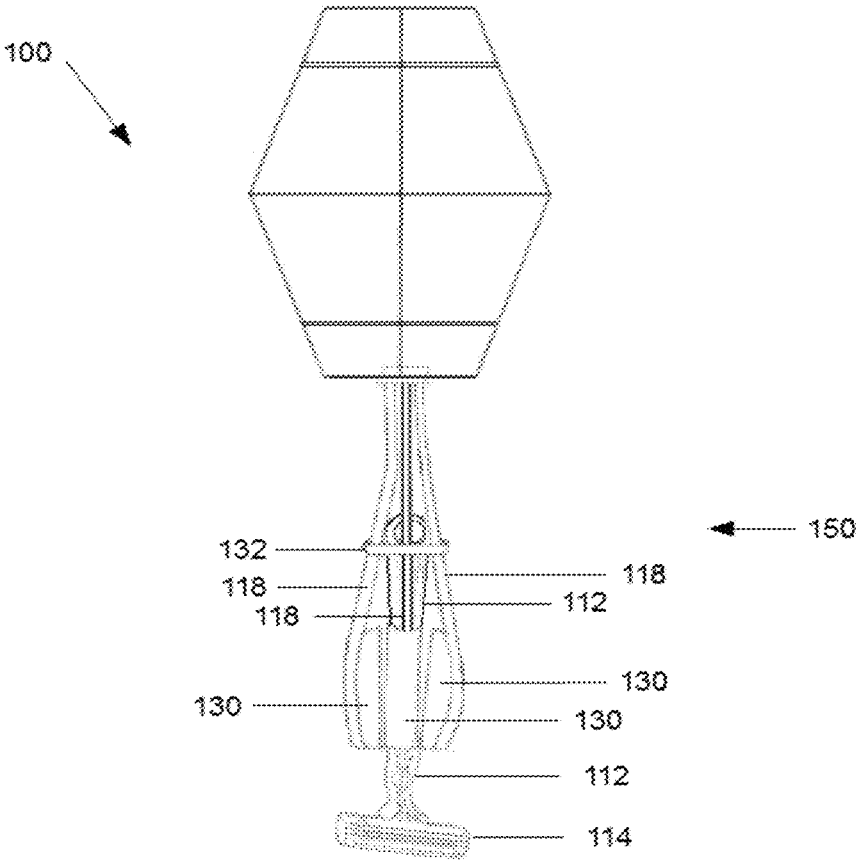
FIG. 8 is a partial perspective view of an electroless razor cleaning appliance of the present invention.

Referring now to FIG. 7 and FIG. 8, the procedural removal of the encrusted debris, largely on the obverse of the disposable shaving instrument 112 head assembly 114, is to continue by loading the disposable shaving instrument 112 into the electroless hydrodynamic disposable razor restoration and rejuvenation appliance 100. The disposable shaving instrument 112 is to be grasped between the forefinger and thumb 120 and inserted into the spring steel arms assembly 118 through the bottom of the instrument handle capture assembly 150. The disposable shaving instrument 112 is then to be tightened against the foam pad assembly 130 by drawing down the ring tension unit 132 until all slack has been removed from between the foam pad assembly 130 and the disposable shaving instrument 112. As an alternate method, the hydrodynamic disposable razor cleaning appliance 100 may be separated into its two major component groups before loading the disposable shaving instrument 112 into the disposable razor restoration and rejuvenation appliance 100. Either way the disposable shaving instrument 112 installation procedure would remain the same.

Figure 9:
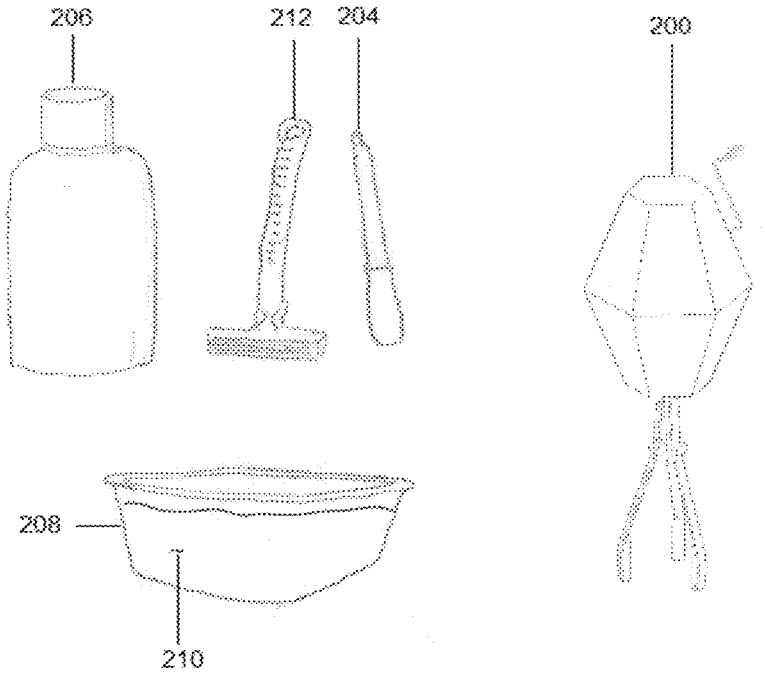
FIG. 9 is a perspective view of system requirements associated with an electroless razor cleaning appliance of the present invention.
Figure 10:
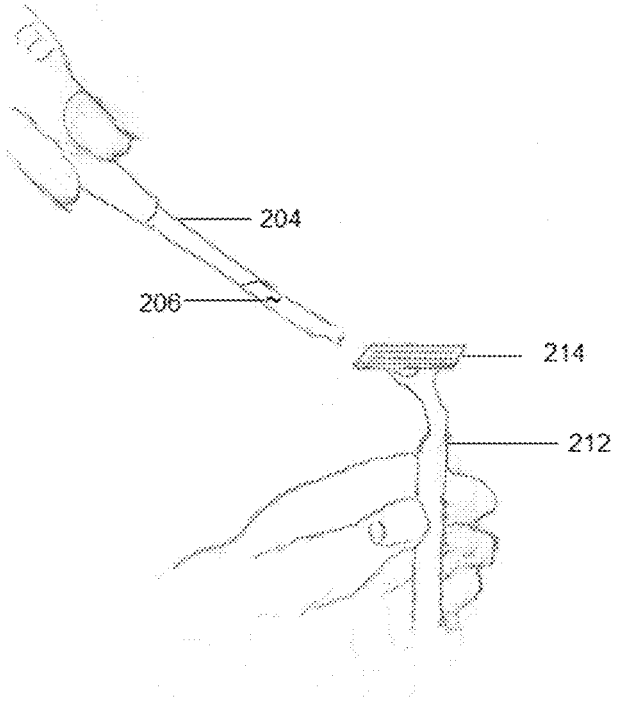
FIG. 10 is a perspective view of system requirements associated with an electroless razor cleaning appliance of the present invention.

Referring now to FIG. 9 and FIG. 10, there are shown the required elements for carrying out a multi-bladed razor 212 cleaning process, wherein routine cleaning of the multi-bladed razor 212 has resulted in only a light-to-moderate buildup of material on the razor 212 head assembly 214. Cleaning is recommended at the end of each use, thus taking advantage of the fact that the shaving residue is already hydrated and thereby eliminating the need to perform the soaking step described earlier. For this procedure the required elements are: a multi-bladed razor 212; a 5 ml eyedropper; 6 ozs of a hygroscopic sanitizer 206 such as glycerol, a skin protectant, available from any pharmacy; a wash stand 208 containing at least two gallons of lukewarm tap water 210 and an electroless hydrodynamic multi-bladed razor restoration and rejuvenation appliance 200.

Still with reference to FIG. 9 and FIG. 10, after shaving, the gross excess shaving cream and loose stubble is to be removed from the multi-bladed razor 212 head assembly 214 under running tap water, followed by the application of 3 drops of the preferred wetting agent, glycerol 206, dispensed from the eyedropper 204 directly onto the multi-bladed razor 212 head assembly 214, allowing a few seconds for any excess liquid to drain away while also giving the germ-killing power of the glycerol 206 a chance to take effect.

Figure 11:
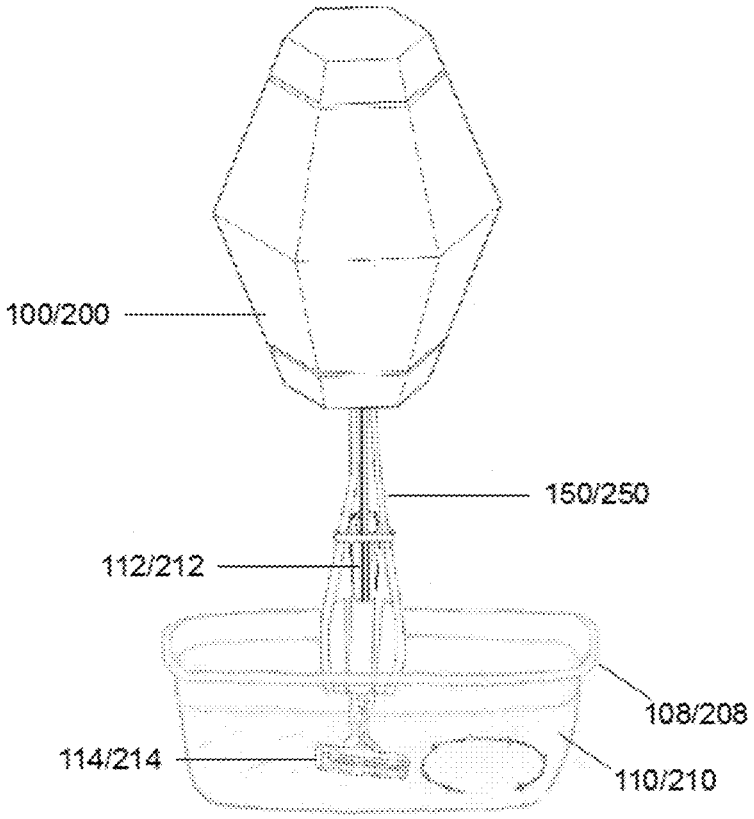
FIG. 11 is a perspective view of an electroless razor cleaning appliance of the present invention.

Referring now to FIG. 11, there are shown the required elements for performing a rejuvenating and/or cleaning operation on a multi-bladed disposable razor 100 or 200. These include a 2½ gallon wash stand or basin 108 or 208 containing at least two gallons of lukewarm tap water 110 or 210 and an electroless hydrodynamic disposable razor restoration and rejuvenation appliance 100 or 200. With one hand positioned in such a way as to grasp the control assembly section of the appliance 100 or 200, the razor handle capture assembly 150 or 250 containing the multi-bladed disposable razor 112 or 212 is to be lowered into the wash stand or basin 108 or 208 until the multi-bladed disposable razor 112 or 212 head assembly 114 or 214 is submerged in the water 110 or 210 halfway between the rim and the bottom of the wash stand or basin 108 or 208.

Still with reference to FIG. 11, there is shown the preferred technique to be used in performing a rejuvenating and/or cleaning operation on a disposable razor 112 or 212, noting that a continuous motion of the rejuvenation and restoration appliance 100 or 200 through the water 110 or 210 is to be regarded as superior to that of a static position. It is in this way that the vortex cleaning forces are kept in a continuous state of escalation and collapse, thereby affecting the distribution and strength of pressure gradients being created all along the length of the mulch-bladed disposable razor 112 or 212 head assembly 114 or 214. Motions that include side to side, up and down and circular patterns are also recommended during the cleaning operation in order to achieve optimal results. It is further recommended that at the conclusion of the cleaning operation, which should require less than one minute to complete, a final few seconds be devoted to spin-drying the multi-bladed disposable razor 112 or 212 by lifting the restoration and rejuvenation appliance 100 or 200 just above the surface of the water bath, thereby eliminating all traces of corrosion-causing excess water.

In further detail, referring now to the invention of FIG. 3 and FIG. 4, the electroless hydrodynamic disposable razor cleaning appliance 04 would stand at a height of 8¼" in relation to the 4¾" length of the standard disposable razor 90. The razor handle capture assembly 80 would stand at a height of 5¼" in relation to the 4¾" length of the standard disposable razor 90. The control head housing assembly 56 in length×width×height dimensions would be 2⅝", 2⅝" and 3.0" respectively in relation to the 4¾" length of the standard disposable razor 90.

The construction details of the invention as shown in FIG. 3 and FIG. 4 are that the body of the control head housing assembly 56 can be made from a rigid polyurethane molding having a wall thickness of 3/32 of an inch, or 0.0937". The drive gear 58 can be made from 3" diameter injection molded gear stock. The output gear 62 can be made from ⅜" diameter injection molded gear stock. The gear subchassis 60 can be made from a polyurethane molding having a wall thickness of 3/32 of an inch. The universal coupler 54 can be made from a ⅜" length of flex-shaft material. The output shaft 64 can be made of standard 3/16 inch steel tubing. The clutch disconnect assembly 68/88 can be a 20 mm servo quick disconnect shaft coupler.

In further detail, now referring to the invention of FIG. 1 and FIG. 2, the electroless hydrodynamic disposable razor cleaning appliance 02 would stand at a height of 8¼" in relation to the 4¾" length of the standard disposable razor 50. The razor handle capture assembly 40 would stand at a height of 5¼" in relation to the 4¾" length of the standard disposable razor 50. The control head housing assembly 10 in length×width×height dimensions would be 2⅝", 2⅝" and 3.0" respectively in relation to the 4¾" length of the standard disposable razor 50.

In further detail, still referring to the invention of FIG. 1 and FIG. 2, the construction details of the invention as shown are that the body of the control head housing assembly 10 can be made from a rigid polyurethane molding having a wall thickness of 3/32 of an inch, or 0.0937". The power spring 18 would be formed by winding a strip of material on an arbor attached to an input shaft 16 within a case or barrel 20 or retaining ring being delivered to an output shaft 28 to create a compact power source. Rotational torque is obtained either from the center arbor or from the barrel. The governor assembly 30 and governor weight set assembly 32 can be procured from telecommunications industry suppliers. The brake assembly 34 would employ a lever or iris activated by a rotatable disk. The clutch disconnect assembly 38/48 can be a 20 mm servo quick disconnect shaft coupler.

The advantages of the present invention include, without limitation, rotational hydrodynamic cleaning action as applied to the blades and structural members of a multi-bladed disposable shaving instrument by employing standing water to create vortex shearing forces that are superior to those that can be created using the average water pressure available from a typical household faucet.

The advantages of the present invention also include, without limitation, elimination of the need to clean multiple bladed disposable shaving instruments as reported in the literature by attempting to mechanically scrape the residue from between the blades or from the blades themselves, noting herein that scraping tools present the potential for nicking the honed edges and thereby leads to the degradation of razor performance.

The advantages of the present invention also include, without limitation, elimination of the need to clean multiple bladed disposable shaving instruments by using a particular type of water jet device, noting herein that said device is complicated and time consuming in the setup process.

The advantages of the present invention also include, without limitation, elimination of the need to clean multiple bladed disposable shaving instruments by using yet another type of water jet device, noting herein that said device relies on a minimum standard water pressure not available at all times in some homes.

The advantages of the present invention also include, without limitation, elimination of the need to clean multiple bladed disposable shaving instruments by using yet another type of water jet device, noting herein that said device is prone to causing unwanted spraying of water over a wide area.

The advantages of the present invention also include, without limitation, elimination of the need to clean multiple bladed disposable shaving instruments as reported in the literature by rinsing in very hot water, noting herein that using very hot water to clean stainless steel blades tends to dull the blades and thereby leads to the degradation of razor performance.

The advantages of the present invention also include, without limitation, the elimination of the need to address a problem as reported in the literature which suggests meticulous removal of the excess water following each use by wiping the blades with some type of absorbent material, noting herein that this does not address parts of the razor that cannot be accessed with surface wiping and thereby permits corrosion to form on the undersides of the blades along with ensuing degradation in razor performance.

In broad embodiment, the present invention has far reaching implications as a cost-saving investment for the home, seeing that—as reported in the literature—disposable razors are typically discarded in an untimely manner. Also in broad embodiment, the present invention has far reaching implications in the area of waste management by helping to reducing the volume of waste flowing into landfills. Also in broad embodiment, the present invention has far reaching implications for reducing or eliminating the biological hazard present in the accumulation of skin cells that have been sloughed off during shaving and allowed to decay on surfaces that are difficult to access by mechanical means.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A method for hydrodynamically removing accumulated debris from a multi-bladed shaving instrument having a handle and a blade portion having a plurality of shaving blades with honed edges using fluid dynamics principles of vorticity and pressure gradients in an appliance comprising a control head housing assembly having an angular displacement drive, and a razor handle capture assembly coupled to the angular displacement drive and having an adjustable razor handle gripping device for securing and immobilizing said multi-bladed shaving instrument, comprising the steps of:

a) preparing said multi-bladed shaving instrument for immersion and agitation in said appliance,
b) placing a first predetermined volume of tap water in a first-liquid medium vessel,
c) placing a suitable amount of a commercially available hydrolyzing agent or wetting agent in liquid form in a second-liquid-medium vessel that when about half full of liquid will just cover said bladed section of said multi-bladed shaving instrument,
d) creating an admixture by pouring the first predetermined volume of tap water from the first-liquid medium vessel into the second-liquid-medium vessel,
e) immersing at least the bladed portion of the multi-bladed shaving instrument into the said admixture within said second-liquid-medium vessel,
f) allowing said bladed section to soak for a predetermined length of time in said admixture,
g) securing the handle of said multi-bladed shaving instrument in said razor handle capture assembly,
h) placing said razor handle capture assembly with said multi-bladed shaving instrument installed into a water bath containing a second predetermined volume of tap water up to a predetermined level marked on an exterior of said razor handle capture assembly, and
i) applying mechanical energy from the angular displacement drive of the control head housing assembly of the appliance to the razor handle capture assembly for a determined time period, such that angular displacement impetus is transmitted through said razor handle capture assembly to said multi-bladed shaving instrument, whereby said multi-bladed shaving instrument is made free of said accumulated debris without impact and/or thermal damage to said honed edges of said plurality of shaving blades of said multi-bladed shaving instrument(s).

2. The method of claim 1 wherein the mechanical energy applied by the angular displacement drive of the control head housing assembly in step (i) is provided by a spring.

3. The method of claim 2, wherein the angular displacement drive of the control head housing assembly comprises a spring, a spring motor input shaft coupled to the spring for winding the spring, a spring barrel output shaft coupled to the spring, a brake assembly coupled to the spring barrel output shaft 34 and a clutch disconnect assembly for coupling to the razor handle capture assembly.

4. The method of claim 3 wherein said razor handle capture assembly comprises a clutch disconnect assembly for coupling with the clutch disconnect assembly of the angular displacement drive.

5. The method of claim 3, wherein the angular displacement drive of the control head housing assembly further comprises a governor assembly having a governor weight set assembly, a governor pinion gear on the output shaft and a governor drive gear meshing with the governor pinion gear and coupled to the governor assembly, such that the governor assembly is driven by the output shaft through the governor drive gear and the governor pinion gear.

6. The method of claim 1 wherein the razor handle capture assembly further comprises an adjustable razor handle gripping device comprising a set of spring steel arms, a foam pressure pad on an end of each of the set of spring steel arms, and a sliding ring tensioner, and in step (g) the handle of said multi-bladed shaving instrument is secured into said razor handle capture assembly by sliding the sliding ring tensioner on the set of spring steel arms, such that the foam pressure pads on the end of the spring steel arms are drawn in and tightened against the handle.

7. The method of claim 1 wherein in step (h), said second predetermined volume of said tap water in said water bath is at least 2 gallons.

8. The method of claim 7 wherein said water bath has a volume of 2½ gallons.

9. The method of claim 1 wherein said second-liquid-medium vessel is a two-ounce condiment container.

10. The method of claim 1 wherein the admixture in step (d) is 50% tap water and 50% commercially available hydrolyzing agent or wetting agent in liquid form.

11. The method of claim 1 wherein said hydrolyzing agent or wetting agent is glycerol.

12. A method for hydrodynamically removing accumulated debris from a multi-bladed shaving instrument having a handle and a blade portion having a plurality of shaving blades with honed edges, using an appliance for hydrodynamically removing said accumulated debris comprising a razor handle capture assembly having a razor handle gripping device for securing and immobilizing said multi-bladed shaving instrument comprising a set of spring steel arms, a foam pressure pad on an end of each of the set of spring steel arms, and a sliding ring tensioner, the method comprising the steps of:

a) holding said multi-bladed shaving instrument between any two digits of one hand, b) applying a hydrolyzing agent or said wetting agent of a type known to be effective against pathogens which typically breed in decomposing matter, including the human skin cells that are drawn in between said shaving blades, drop wise upon said shaving blades of said multi-bladed shaving instrument using a drop dispenser, c) allowing a predetermined length of time for said hydrolyzing agent or said wetting agent to work, d) adjusting the sliding ring tensioner of the razor handle gripping device to a point of greatest relaxation, e) inserting the handle of said multi-bladed shaving instrument into the razor handle gripping device of the razor handle capture assembly of said appliance through a lower opening to a point where the handle can not be inserted any further, f) readjusting said sliding ring tensioner to its a point of greatest resistance to further tightening while making any necessary adjustments to a positioning of said handle of said multi-bladed shaving instrument, g) placing said razor handle capture assembly of said appliance with said multi-bladed shaving instrument into a liquid medium vessel containing a predetermined volume of tap water up to a predetermined level marked on an exterior of said razor handle capture assembly, h) continuously moving said razor handle assembly of said appliance within said liquid medium vessel, either in side-to-side motion or up-and-down motion and/or swirling motions for a predetermined length of time, and i) raising said razor handle capture assembly of said appliance out of said tap water and allowing free air to take the place of said tap water over a predetermined length of time in order to remove all traces of liquid from said shaving blades of said multi-bladed shaving instrument.

13. The method of claim 12, wherein said hydrolyzing agent or said wetting agent is glycerol, whereby said glycerol hygroscopically withdraws water from the cells of said pathogens.

14. An appliance for hydrodynamically removing debris from a multi-bladed shaving instrument having a handle and a blade portion having a plurality of shaving blades with honed edges, using fluid dynamics principles of voracity and pressure gradients, comprising a) a control head housing assembly having a variable-speed angular displacement drive, b) a razor handle capture assembly coupled to the angular displacement drive and having an adjustable razor handle gripping device for securing and immobilizing the handle of said multi-bladed shaving instrument.

15. The appliance of claim 14 wherein said variable-speed angular displacement drive mechanism comprises a hand crank driving a universal coupler rotatably coupled to a drive gear meshing with an output gear providing rotational energy to an output shaft.

16. The appliance of claim 15 wherein said angular displacement drive mechanism further comprises a clutch disconnect assembly on an end of the output shaft.

17. The appliance of claim 14 wherein said razor handle capture assembly further comprises a universally adjustable confinement mechanism comprising a sliding ring tensioner, a set of spring steel arms, and a foam plastic pressure pad on an end of each of the set of spring steel arms, so that a handle of a multi-bladed shaving implement is secured in the confinement mechanism by sliding the sliding ring tensioner on the set of spring steel arms, such that the foam pressure pads on the end of the spring steel arms are drawn in and tightened against the handle.

* * * * *